US006244785B1

(12) United States Patent
Richter et al.

(10) Patent No.: US 6,244,785 B1
(45) Date of Patent: Jun. 12, 2001

(54) PRECAST, MODULAR SPAR SYSTEM

(75) Inventors: Kirk T. Richter, Boerne; Moon A. Fahel, San Antonio, both of TX (US)

(73) Assignee: H. B. Zachry Company, San Antonio, TX (US)

( * ) Notice: Subject to any disclaimer, the term of this patent is extended or adjusted under 35 U.S.C. 154(b) by 0 days.

(21) Appl. No.: 09/308,019

(22) PCT Filed: Nov. 12, 1997

(86) PCT No.: PCT/US97/21053

§ 371 Date: May 12, 1999

§ 102(e) Date: May 12, 1999

(87) PCT Pub. No.: WO98/21415

PCT Pub. Date: May 22, 1998

Related U.S. Application Data

(60) Provisional application No. 60/030,583, filed on Nov. 12, 1996.

(51) Int. Cl.[7] ..... E02D 23/00; E02D 27/24; E02D 29/00

(52) U.S. Cl. ..... 405/195.1; 405/223.1; 405/224; 114/264; 114/265; 114/125

(58) Field of Search ..... 405/195.1, 223.1, 405/224; 114/125, 264, 265

(56) References Cited

U.S. PATENT DOCUMENTS

| | | | | |
|---|---|---|---|---|
| Re. 30,590 | * | 4/1981 | Blenkarn | 405/202 |
| 3,299,846 | * | 1/1967 | Jarlan | 114/264 |
| 3,572,041 | * | 3/1971 | Graaf | 61/46.5 |
| 3,698,198 | | 10/1972 | Phelps | 61/46.5 |
| 4,241,685 | | 12/1980 | Mougin | 114/264 |
| 4,606,673 | * | 8/1986 | Daniell | 405/195.1 |
| 4,702,321 | * | 10/1987 | Horton | 114/264 |
| 4,813,815 | * | 3/1989 | McGehee | 405/224 |
| 5,330,293 | * | 7/1994 | White et al. | 405/224 |
| 5,439,321 | * | 8/1995 | Hunter | 405/195.1 |
| 5,447,392 | * | 9/1995 | Marshall | 405/223.1 |
| 5,507,598 | * | 4/1996 | Huete | 405/223.1 |
| 5,513,929 | * | 5/1996 | Calkins et al. | 405/195.1 |
| 5,558,467 | * | 9/1996 | Horton | 405/195.1 |
| 5,567,086 | * | 10/1996 | Huete | 405/223.1 |
| 5,636,943 | | 6/1997 | Haney | 405/195.1 |
| 5,683,205 | | 11/1997 | Halkyard | 405/224.2 |
| 5,706,897 | | 1/1998 | Horton, III | 166/359 |
| 5,722,492 | | 3/1998 | Finn | 166/367 |
| 5,722,797 | * | 3/1998 | Horton, III | 405/224 |
| 5,758,990 | | 6/1998 | Davies et al. | 405/242.2 |
| 5,775,845 | | 7/1998 | Wybro | 405/195.1 |
| 5,855,178 | | 1/1999 | Treau et al. | 114/230 |
| 5,865,566 | | 2/1999 | Finn | 405/169 |
| 5,873,416 | | 2/1999 | Horton, III | 166/344 |
| 5,873,677 | | 2/1999 | Davies et al. | 405/195.1 |
| 5,875,728 | * | 3/1999 | Ayers et al. | 114/264 |
| 5,881,815 | | 3/1999 | Horton, III | 166/350 |
| 5,887,659 | | 3/1999 | Watkins | 166/350 |
| 5,924,822 | | 7/1999 | Finn et al. | 405/209 |
| 5,931,602 | | 8/1999 | Gulbrandsen et al. | 405/224 |
| 5,971,075 | | 10/1999 | Odru et al. | 166/350 |
| 5,983,822 | * | 11/1999 | Chow et al. | 114/264 |
| 6,012,873 | * | 1/2000 | Copple et al. | 405/224 |
| 6,027,286 | * | 2/2000 | Pollack | 405/195.1 |

* cited by examiner

*Primary Examiner*—Eileen D. Lillis
*Assistant Examiner*—Alexandra K. Pechhold
(74) *Attorney, Agent, or Firm*—Royston, Rayzor, Vickery, Novak & Druce, L.L.P.

(57) ABSTRACT

A precast, modular spar system (10) having a cylindrical open-ended spar of relatively uniform cross section. The spar has a freeboard section (50), a buoyancy section (70), and a ballast section (90). The sections are formed by joining arcuate segments and stacking the sections. A pressurizing system allows for the injection of air into the segments to vary the buoyancy of the modular spar system.

16 Claims, 13 Drawing Sheets

PRECAST, MODULAR SPAR SYSTEM

This application claims benefit of Provisional Appln. Ser. No. 60/030,583 filed Nov. 12, 1996.

BACKGROUND OF THE INVENTION

The present invention relates to a precast, modular spar system and method for constructing same for deep water oil and gas exploration, drilling, production, and storage. The spar system supports a production deck above the sea level and a riser system connecting a subsea well installation on the sea floor with the production deck. The riser system extends through a central longitudinal passageway in the spar.

An important part of the world's production or oil and gas is derived form offshore wells. While the early offshore oil and gas fields were in relatively shallow water, the need to develop oil fields in deep water has become more important as the shallow water oil and gas fields become depleted. As such, many deep water basins throughout the world have been opened to oil and gas exploration and drilling.

The original deep water applications used large drilling platforms such as concrete gravity based structures. However, as the depth increased, alternative platform methods were proposed such as steel jacket type structures fixed to and resting upon the sea floor, guyed towers, or tensioned leg platforms. Tensioned leg platforms are floating structures used in medium to deep water and in calm to rough seas. The tensioned leg platform is held below its normal buoyancy level by vertical steel mooring lines or tethers. Control of its movement in the waves and currents is similar to that of a seaway marker buoy held by a tight cable with just enough freedom to allow limited horizontal movement. The tension leg platform concept was first used in 1984 as a steel structure in about 147 meters of water and is currently being used in about 350 meters of water.

An alternative method is the floating production systems which is used in deep water or in shallow waters that are isolated from production export facilities. The floating production system drills and completes wells and contains the tools necessary to operate the subsea system. Components are assembled on the floating production system and installed remotely by a subsea vehicle. Wells pumps the heavy crude oil to jumpers which are attached to a central manifold. A floating production, storage and off loading vessel receives the crude oil from the manifold and performs initial processing and storing of the crude oil. The crude oil is off loaded to a shuttle tanker for delivery and final processing at a refinery. Another proposal is a free standing riser system which can be used in medium to deep water. Wells are drilled and completed within a subsea template. A free standing riser carries the individual flow lines that exit the riser just below sea surface. Flexible lines connect the riser to a semi-submersible production platform.

Recently, the world's first metal production spar was installed in the Gulf of Mexico to develop an oil and gas field in the deep waters of the Gulf of Mexico, some 90 miles off the coast. A spar is a deep draft floating caisson or hollow cylindrical structure similar to a buoy. Like a buoy, a spar floats and is moored or anchored to the sea floor. Spars have been used for decades as marker buoys and for gathering oceanographic data.

Although spars have been used in the past to store oil, this new production spar is the first to be used to support a production deck with buoyant well risers through the center passageway. Oil and gas gathered from wells drilled on the sea floor will be processed to pipeline quality and transported to shore. The metal spar has two main sections: the hull and the production deck. The hull is a hollow cylindrical metal structure 705' long, 72' in diameter, and weighing 12,640 tons. The hull was manufactured in Finland and shipped across the Atlantic Ocean aboard heavy lift vessels as two separate sections until reaching the Gulf of Mexico. There, the two separate sections of the spar were brought back to shore and welded together at a shipyard. The entire welded hull was then towed horizontally to the project site and upended to the vertical position by filling its lower ballast tanks with water. About ninety percent of the spar structure is below sea level with about fifty five feet above sea level to support the three story production deck and facility. The metal spar is moored in almost 2,000 feet of water by a series of chains and cables to six piles, each sunk 180 feet into the sea floor. Production risers from the subsea well are threaded through the center passageway of the spar. The production deck is a three level deck designed to accommodate 25,000 barrels of oil per day and 30 MMcf of gas per day. Facilities and crew living quarters are located on top of the floating hull section.

In general, each of the current oil and gas production systems have benefits, but also significant disadvantages. Most can only be used only within its specific application. And, although the spar is considered less expensive than the other typical production systems to develop a field in almost 2,000 feet of water, it still requires a coordinated international team effort to construct, ship, assemble, and tow to the production site.

SUMMARY OF THE INVENTION

The present invention contemplates a novel precast, modular spar system and method of constructing same for drilling, oil and gas production, and oil storage in a variety of water depths. The spar consists of arcuate shaped concrete segments cast and assembled onshore to form a cylindrical module having a central longitudinal passageway. The modules are assembled onshore to form cylindrical units which are then assembled onshore or offshore to form the final cylindrical spar of the desired length and width for the specific production site. If final assembly of the spar occurs onshore, the structure is towed horizontally to the production site and upended. If final assembly of the spar occurs offshore, the modules are towed either vertically or horizontally to the production site. At the production site, the modules are vertically assembled to form the final spar structure. The spar is adapted to have a length in which its normal draft places the bottom of the spar at a location sufficiently below the water surface that the effect of waves is attenuated to very low amplitudes and wave excitation forces are relatively small. The heave motion of the spar may thereby be reduced to almost zero even in the most severe seas while surge, sway, roll and pitch motions will remain within readily acceptable limits.

The invention further contemplates an equalized pressure system consisting of a vertical column of water with a segmental length positioned concentrically along the entire length of the buoyant section of the spar and an equalized pressure pipe system for pressurizing the interior compartments of the segments to equal the pressure of the adjacent sea water. The equalized pressure pipe system is also used in the upending process and in maintaining a constant draft of the spar at the specific production site.

The present invention is intended to provide (a) a spar of novel precast modular construction which can be economically used from shallow to deep water applications for oil storage facilities, oil and gas production facilities, and a riser system;

(b) an independent structure which can be used with several different types of production systems;

(c) a structure which has low sensitivity to fatigue or sea water corrosion, and which is resistant to the chemical and mechanical deterioration associated with freezing and thawing; and (d) a spar buoy which provides enhanced stability in a floating catenary moored condition.

DETAILED DESCRIPTION OF THE PREFERRED EMBODIMENT

Figure 1:
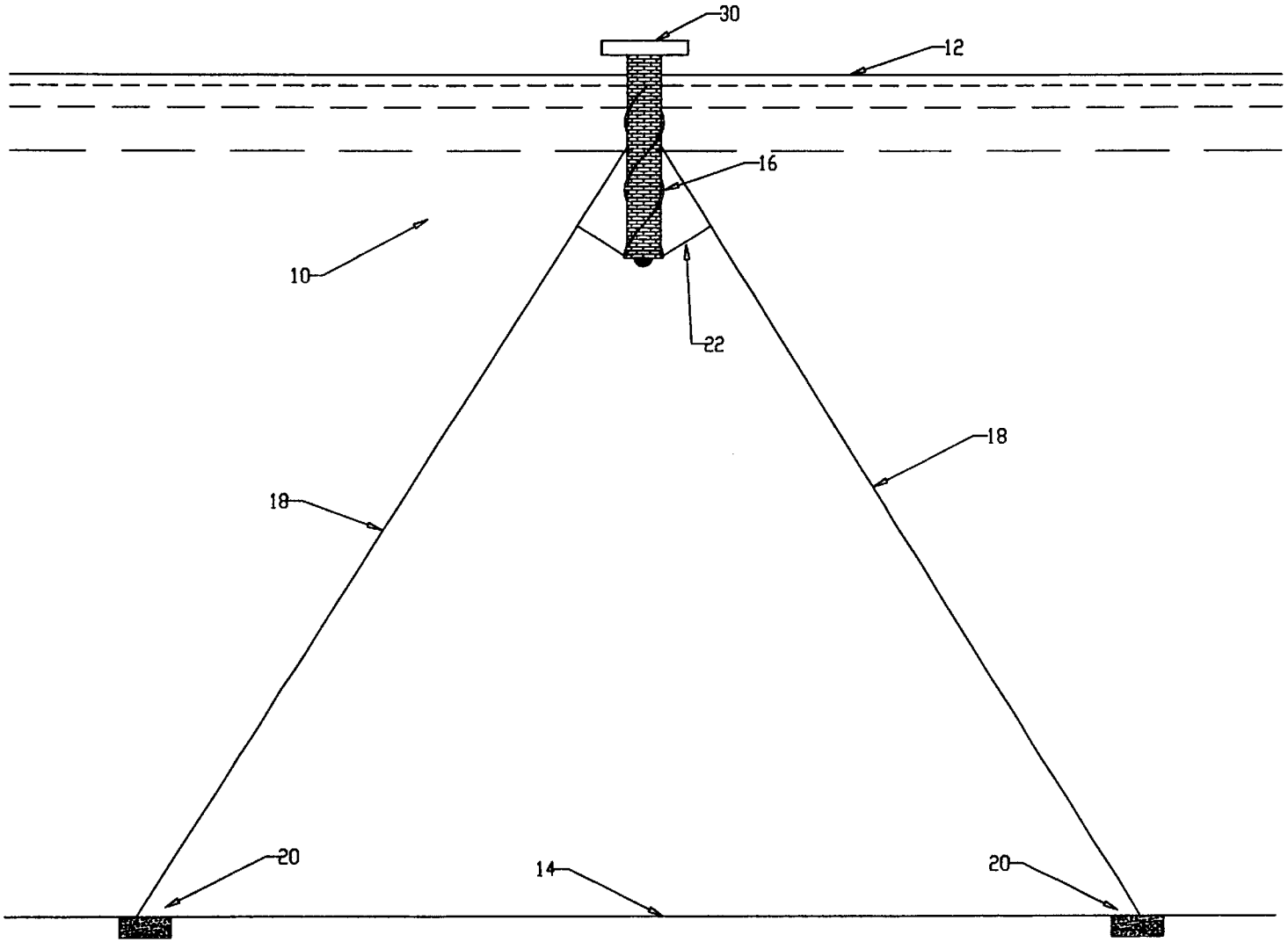
FIG. 1 is an elevation view of a spar system platform constructed in accordance with this invention.
Figure 2:
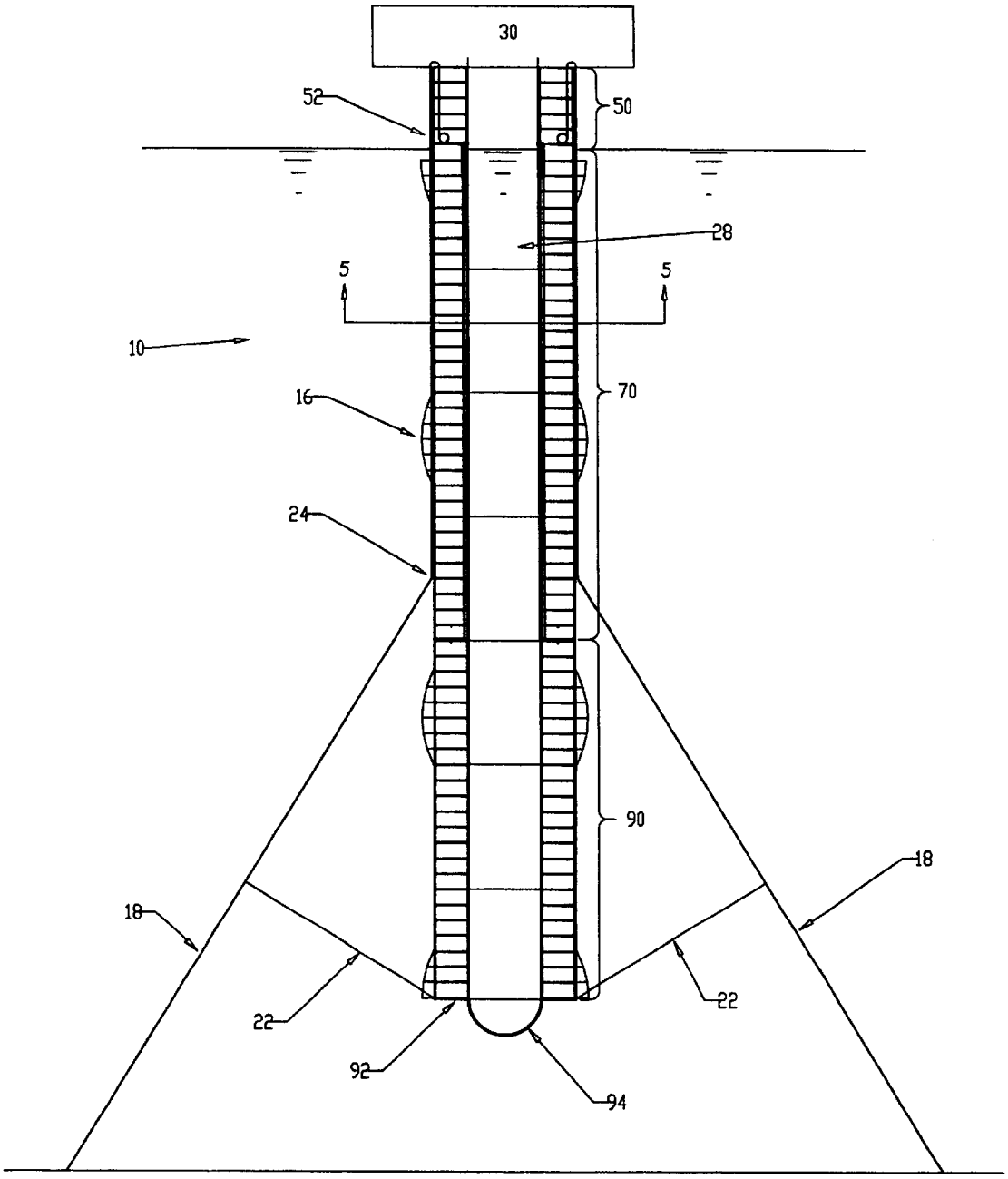
FIG. 2 is a vertical sectional view of the spar illustrated in FIG. 1.
Figure 4:
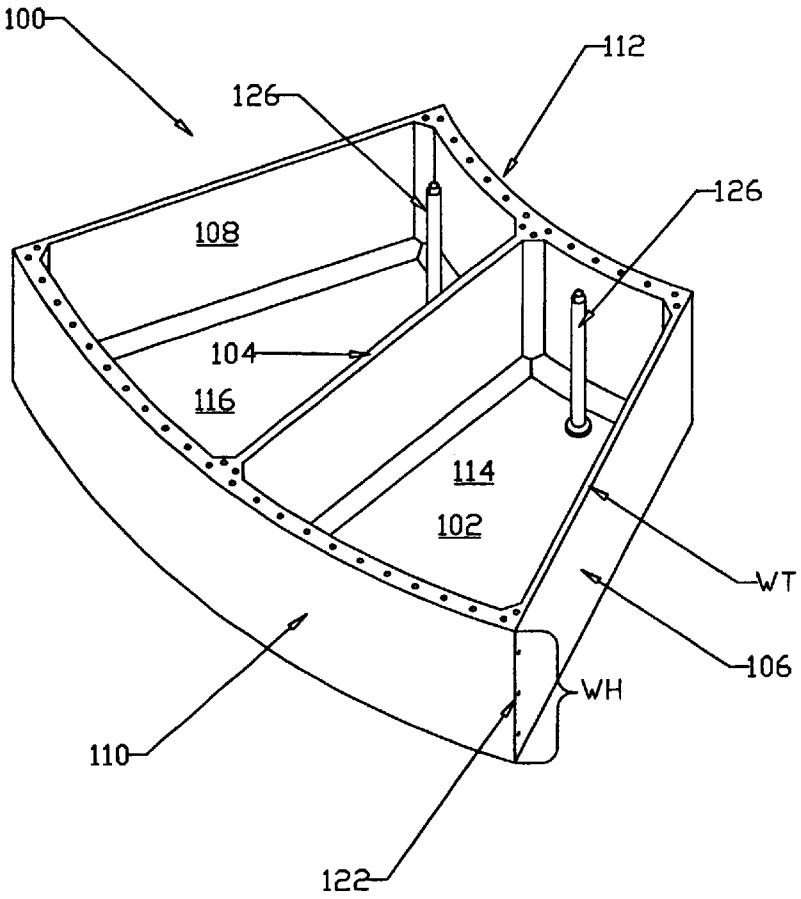
FIG. 4 is a bottom isometric view of a segment for the buoyancy section of the present invention.
Figure 3:
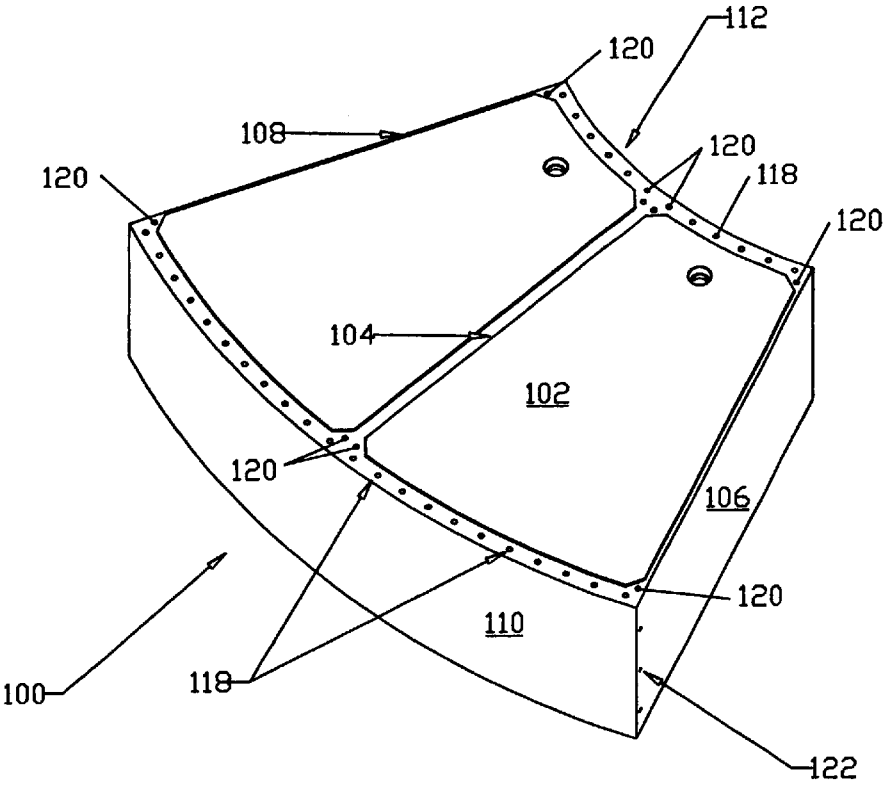
FIG. 3 is a top isometric view of a segment for the buoyancy section of the present invention.

Referring to the drawings in general but FIGS. 1 and 2 in particular, a precast, modular spar (10) embodying this invention is shown. The spar may be located over a subsea installation on the sea floor and may be connected thereto by a riser system (not shown). The spar is generally an elongated cylindrical structure having a freeboard section (50), a buoyancy section (70) substantially submerged in the water, and a ballast section (90) attached beneath the buoyance section. The freeboard section (50) supports a platform deck (30) at a selected height above he water surface (12) to provide suitable clearance of the platform deck structure above expected waves. The platform deck (30) is adapted to support a production deck and associated facilities and equipment (not shown). The spar includes an axial longitudinal passageway (28) which extends from the top of the spar to the keel (92). The keel (92) has a draft below any significant expected wave action at the production site. Ports on the freeboard section release pressure from breaking waves (not shown). Strakes (16), on the outer part of the spar (10), have horizontal surfaces which further help resist heave motions. From the bottom portion of the spar a plurality of riser pipes forming a riser system may extend to a sea floor template (not shown). The spar is anchored by a plurality of taut mooring lines (18) secured at one of their ends to the sea floor by anchors (20) embedded in the sea floor (14) and secured at their other end to the spar (10) at a selected point (24) near the center of rotation. Transverse anchor lines or tethers (22) provide additional stability during strong wind and current loading as described below:

Turning to FIG. 4 it may be seen that segment (100) is the building block of a modular offshore structure constructed in accordance with the present invention. The segment (100) is a unitized product that can be mass produced in varying shapes to construct the desired structure. The segment (100) may be joined to form circular modules that make a donut like object; a rectangular or square box that make a barge like object; or other shapes adapted for specific applications. The segment is manufactured from reinforced concrete materials that are cast in molds or forms to produce uniform products. The segment has perimeter and interior walls with sufficient thickness for structural strength and for housing conduits or ducts for passage of the post-tensioning tendons or strands that couple several segments to form larger modules, that will form units, and that will ultimately form the final structure being constructed.

In the preferred embodiment, the segments and how they are combined to construct the spar may be seen in FIGS. 3–7. The segment (100) is precast, post-tensioned, reinforced concrete with an arcuate shape. Segments for the buoyancy section include a top slab (102), one middle tangential wall (104), two outer tangential walls (106, 108), one outer radial wall (110), one inner radial wall (112), and two separate cells (114, 116). The outer and inner radial walls connect to the two outer tangential walls. The top slab spans all of these walls forming the cells (114, 116). The walls are sufficiently thick to house a plurality of reinforcing steel and post-tensioning conduits (118, 120, 122) and to withstand the expected forces. Keyways (124) (FIG. 9) are cast at the top portion of all the walls to facilitate segment stacking. The segments can be adapted to a variety of applications by varying the wall thickness (Wt) from five centimeters to two hundred centimeters and the wall height (Wh) from one meter to one hundred meters. In the preferred embodiment the tangential walls (106, 108) are approximately fifteen centimeters thick and four meters tall. The radial walls (110, 112) are approximately forty centimeters thick and four meters tall. The top slab varies in thickness from twenty centimeters where it intersects the inner radial wall (112) to twenty-five centimeters at the outer radial wall (110). A double walled pipe (126) extends through the top slab (102) and into each cell (114, 116) of the segment. The segments (100) for the bottom rows of the buoyancy section (70) have trim valves (128) extending through the top slab (102) (See FIG. 9). The fill valves (138) will allow water to enter the buoyancy segments from the ballast section (90) in a controlled manner during the upending process.

Figure 8:
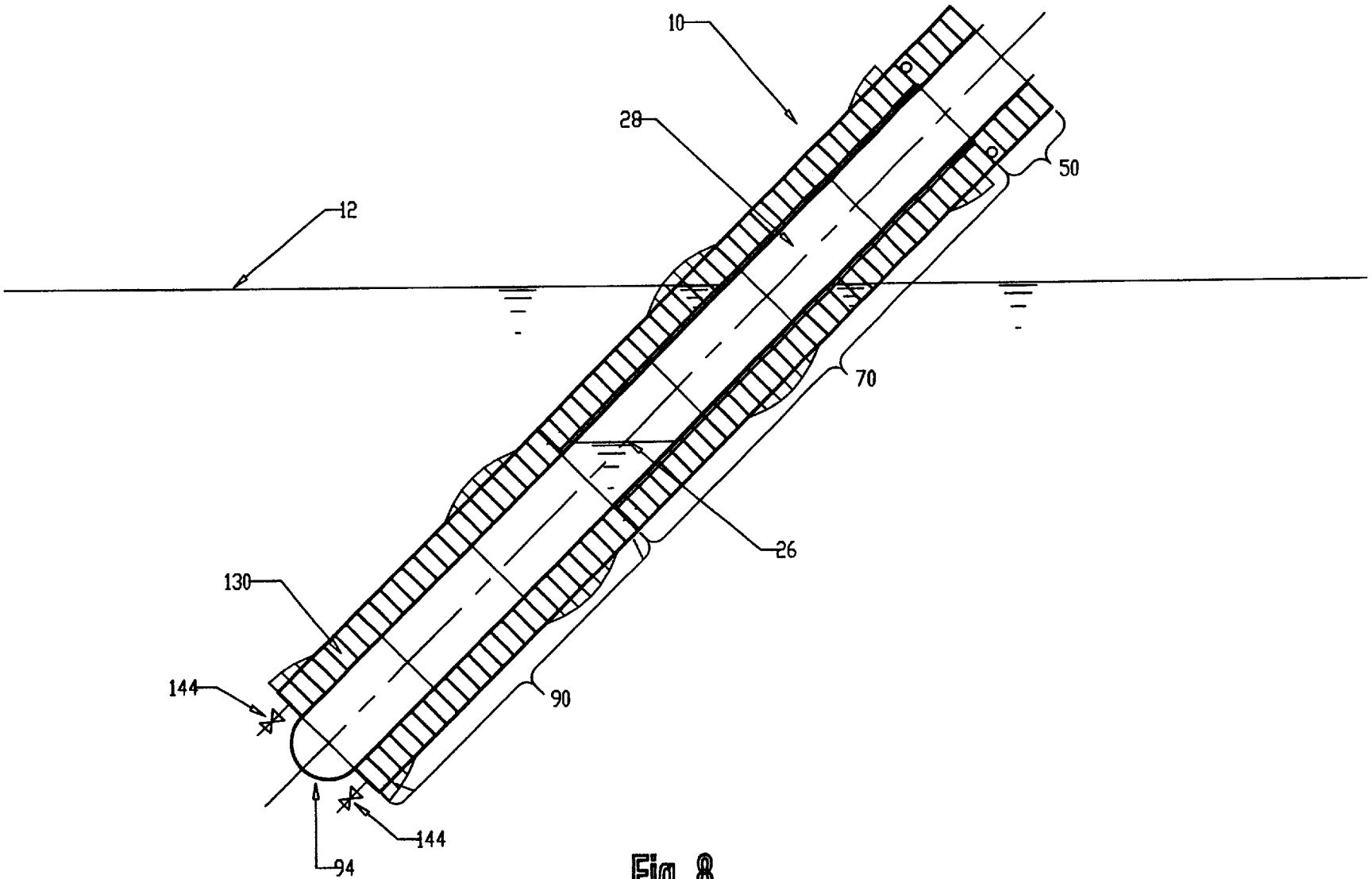
FIG. 8 is a sectional view of the spar disclosed in FIG. 1 during the upending process.

The segments (130) for the ballast section (90) are cast in a similar manner to the segments (100) for the buoyancy section (70) with the addition of a passageway (133) through the top slab (132). The passageway (133) allows for rapid flooding of the ballast section during the upending process. The segments for the bottom of the ballast section are cast with a bottom slab and a fill valve (144) extending through the bottom slab (as shown in FIG. 8). The fill valves will allow water to enter the ballast section in a controlled manner during the upending process. The segments for the top of the ballast section do not have the passageway (133) but do have fill valves (138) extending through the top slab (132) to allow water to enter the buoyancy section (70) segments from the ballast section (90) in a controlled manner during the upending process. Once flooded, the buoyancy section provides added weight to stabilize the structure. The buoyancy section segments may be filled with other heavy dense material to add weight for additional stability.

Figure 5:
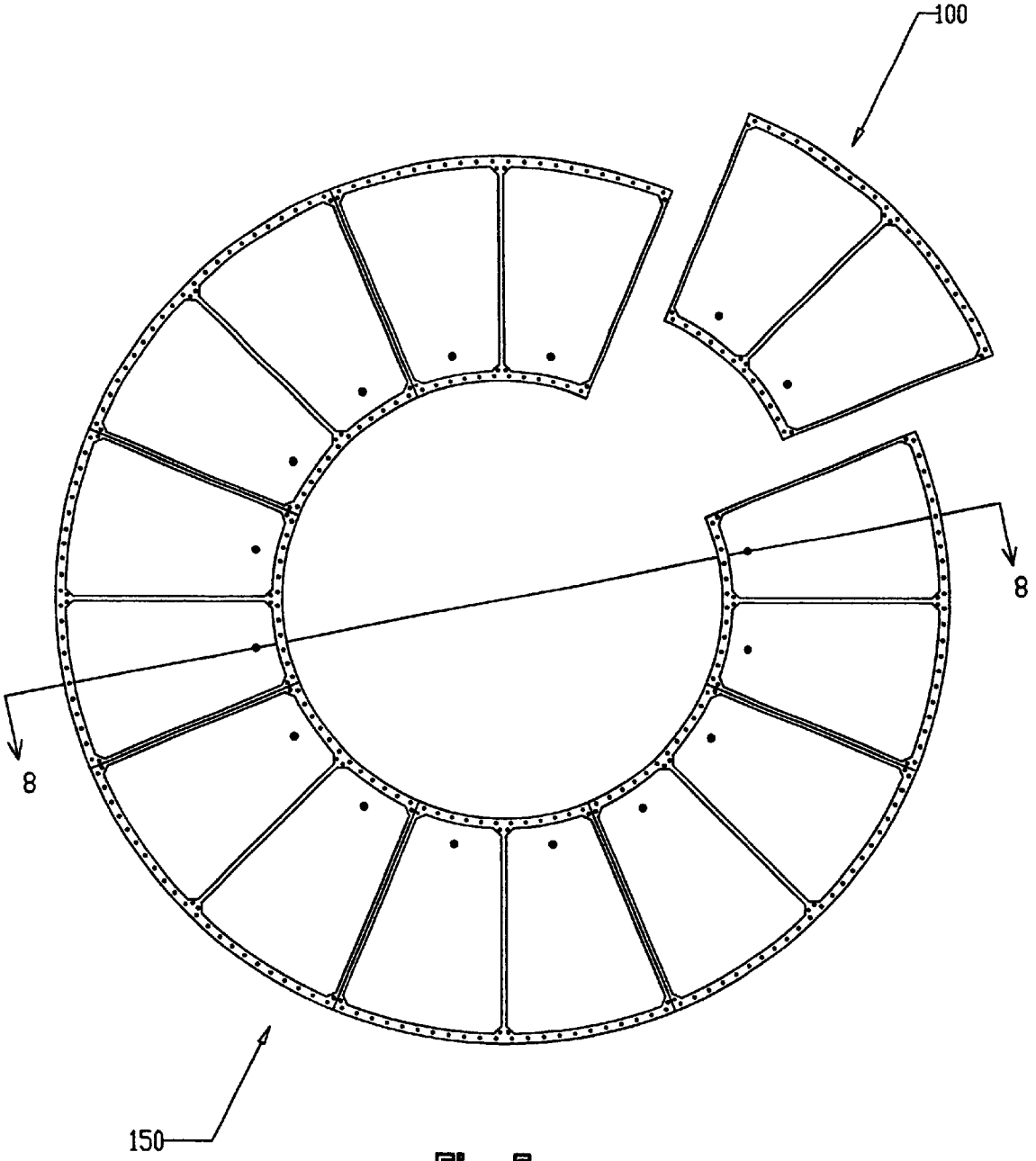
FIG. 5 is a cross sectional view of a buoyancy module indicated by sectional view referenced in FIG. 2.
Figure 7:
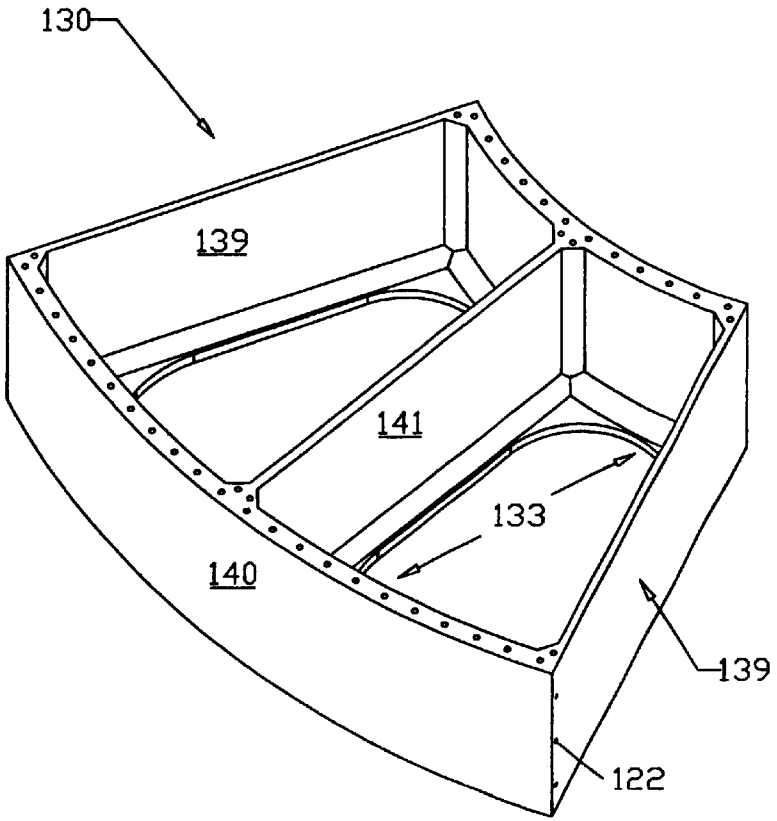
FIG. 7 is a bottom isometric view of a segment for the ballast section of the present invention.
Figure 6:
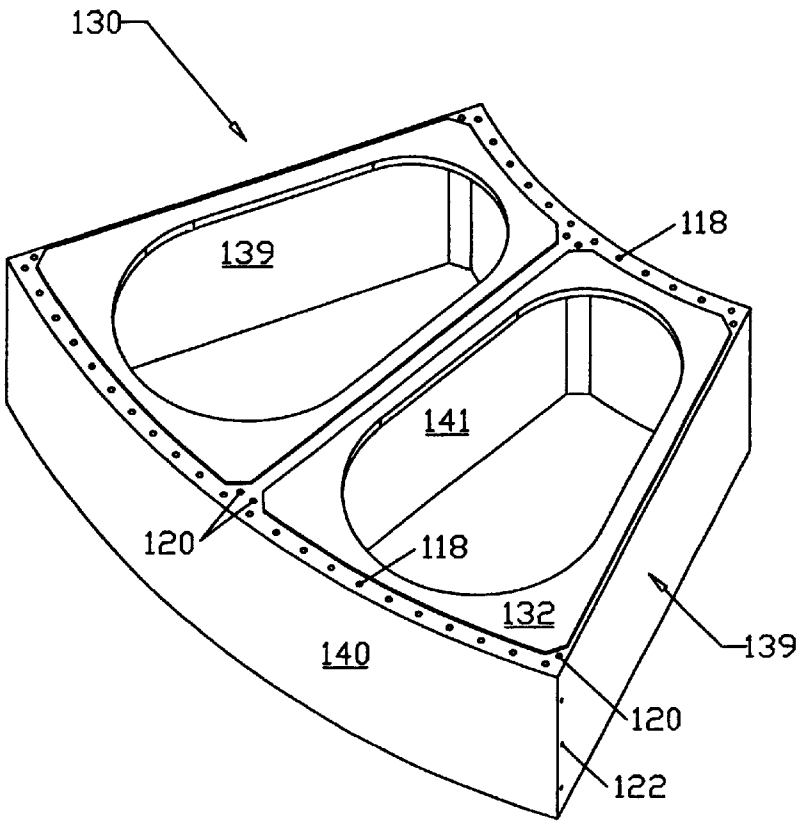
FIG. 6 is a top isometric view of a segment for the ballast section of the present invention.

As shown in FIG. 5, a plurality of segments (100) form a module (150). If the module is to be a donut shape for a cylindrical structure, a plurality of segments are joined together with adhesive type material between the respective contact surfaces and then wrapped with wire or tendons through conduits (122) around the outer radial wall and post-tensioned to a predetermined value. A similar procedure will be followed if the module is not cylindrical in cross section.

Figure 13:
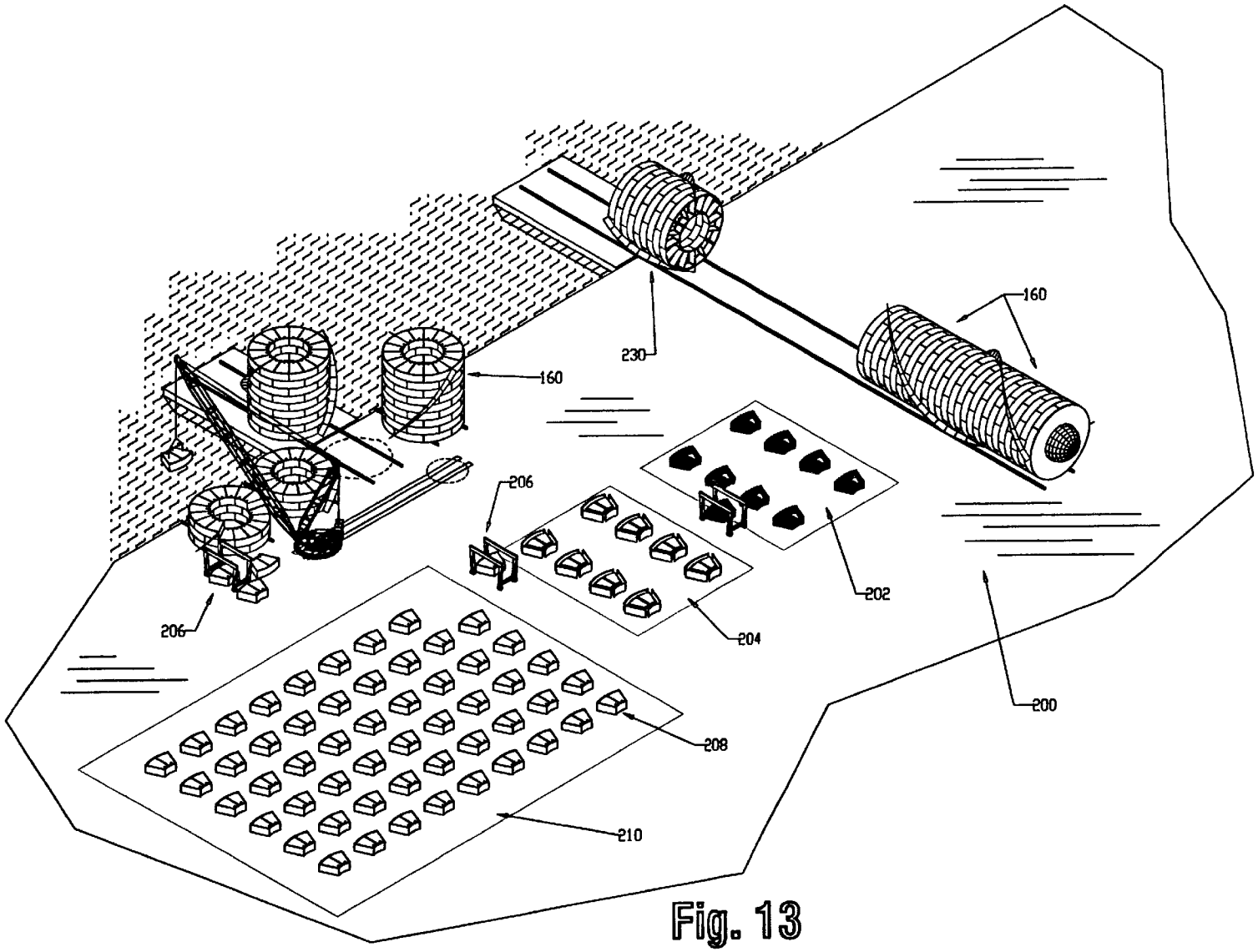
FIG. 13 is an aerial view of a construction plant showing one method of fabricating and erecting the spar disclosed in FIG. 1.

A plurality of modules (150) may be stacked to form a unit (160) as shown in FIG. 13. A unit (160) can be assembled either on shore or on barges by either stacking the modules (150) vertically or aligning them horizontally as they lie on their sides to form a large portion of the intended structure. In the preferred embodiment, the donut shaped modules (150) are stacked by placing the opened bottom of one module on top of the top slab of the previous module with adhesive materials between the contact surfaces, and then compressing the modules together with wires or tendons (121) passed through the conduits (120) provided in the outer walls. The number of units (160) required for the spar (10) are usually kept to a minimum by making the unit (160) as large as possible without exceeding the available transportation or lifting capacities. Preferably, the unit (160) may be 100 feet in length and will be fully outfitted for immediate installation upon receipt at the final assembly location.

A spar structure (10) is a plurality of the units (160) that are assembled either on shore or on barges at the production site. The structure is assembled by either stacking the units vertically or aligning them horizontally to form the intended structure with the desired width, height, depth, and/or volume adapted to support the weight of the freeboard section (50) above the water surface (12) while in normal operation. In the preferred method, the structure is assembled near the shore and a precast, reinforced concrete compression dome (94) is attached to the keel (92) of the spar structure. The compression dome (94) is a convex shaped concrete slab that seals the bottom opening of longitudinal passageway (28) to form the moon pool (26) and to allow the structure to be upended without flooding the moon pool. The compression dome (94) may also seal the bottom of the modules (130) making up the bottom row of modules in the ballast section (90). The complete structure is towed to the production site keel first with the compression dome (94) acting as a bow. Alternatively, the final assembly of the spar can be accomplished at the production site by stacking the units. The structure is vertically post-tensioned by wires or cables placed through the conduits or ducts in the outer walls.

Upending Process

An upending process is used to take the spar from the horizontal towed position to the vertical operational position and is best illustrated in FIGS. 2 and 8. If the draft of the spar (10) is such that the longitudinal passageway (28) is in the water when the spar floats horizontally, a temporary water tight seal can be secured to the top of the freeboard section (50) to keep water substantially out of the longitudinal passage (28) during the towing process. The upending process begins with the opening of the ballast section's lower fill valves (144) (See FIG. 8) to allow water to enter the ballast section segments (130). The moon pool (26) is substantially empty when the fill valves are opened. As the ballast section (90) fills with water, the spar (10) will begin to incline from the horizontal position to the vertical position. If a temporary seal was attached to the top of the spar, it is removed. The buoyancy section fill valves (138) (FIG. 9) are opened either as the ballast section is filling with water or after the ballast section is substantially filled with water. As the lower module of the buoyancy section (70) is filled with water, the water will exit the module by entering the double walled pipe (126) and flowing to the above modules. As each successive row, of buoyancy section modules is filled with water, the water will continue to flow upward through the double wall pipe (126) into the next higher segment (100).

During the upending process, the majority of the buoyancy keeping the spar afloat is provided by the moon pool (26). Water is added to the moon pool (26) to increase ballast and lower the spar (10) into the water. The descent of the spar is controlled by the amount of water in the moon pool (26). Water is added to the top of the moon pool (26) to increase the ballast weight and cause the structure to be upended.

Once the spar (10) is almost vertical, the volume of air keeping the spar afloat is transferred from the moon pool (26) to the buoyancy section (70). The buoyancy section trim valves (128) and the fill valves at the top of the ballast section (138) are closed to not allow any additional water to flood the buoyancy section (70) from the ballast section (90). The redistribution of buoyant air from the moon pool (26) to the buoyancy section (70) is accomplished by injecting air through air inlets (74) (FIG. 9) into the buoyancy section (70) forcing the water out of the buoyancy section segment (70) and into the moon pool (26). To imbalance, air is first injected into the upper modules of the buoyancy section (70) evacuating the water and pressurizing the modules to approximately the same pressure as the adjacent sea water. A remote controlled air system control valve (76) is used to control the injections of air into the equalized pressure system. Once these upper modules are drained of water, the lower modules of the buoyancy section (70) are sequentially pressurized, from the bottom upward, thereby forcing the water from the lower modules all the way up through the buoyancy section (70) and out into the moon pool (26). The ballast section fill valves (144) can be closed to not allow any additional sea water into the ballast section (90). The compression dome (94) is then either disconnected and allowed to drop to the sea floor (14) or ports in the compression dome are opened to allow sea water to freely flow into the moon pool. The upending process ends with the ballast section (90) providing ballast, the buoyancy section (70) providing the necessary buoyancy, and the moon pool (26) filled with sea water.

Pre-installed mooring lines (18) are connected to the spar. The mooring lines extend up the side of the spar and connect to mooring line storage reels (52) located at the freeboard section (50). Unique mooring tethers (22) connect the keel (92) or lower end of the spar (10) to the mooring lines (18), one for each mooring line. These tethers (22) reduce tilt of the spar during strong currents and winds by transferring loads to opposing mooring lines.

After the spar is in a moored and stabilized vertical position, the freeboard section (50) will be extending out of the sea water a sufficient distance to receive a platform deck (30). A platform deck (30) can be attached to the spar by lowering the spar into the water and floating the deck over the spar for attachment. The lowering of the spar is controlled by using the equalized pressure system to allow water into the segments (100) of the buoyancy section (70) up through the double walled pipes (126). Once the deck is attached, the spar is raised to keep the deck above the water for the anticipated sea conditions. To raise the spar, the equalized pressure system is again used to force water up and out of the buoyancy section (70) through the double walled pipes (126) and into the moon pool (26) as indicated above. Alternatively, the deck can be constructed onsite using a heavy lift derrick barge crane without lowering the spar.

Equalized Pressure System

Figure 9:
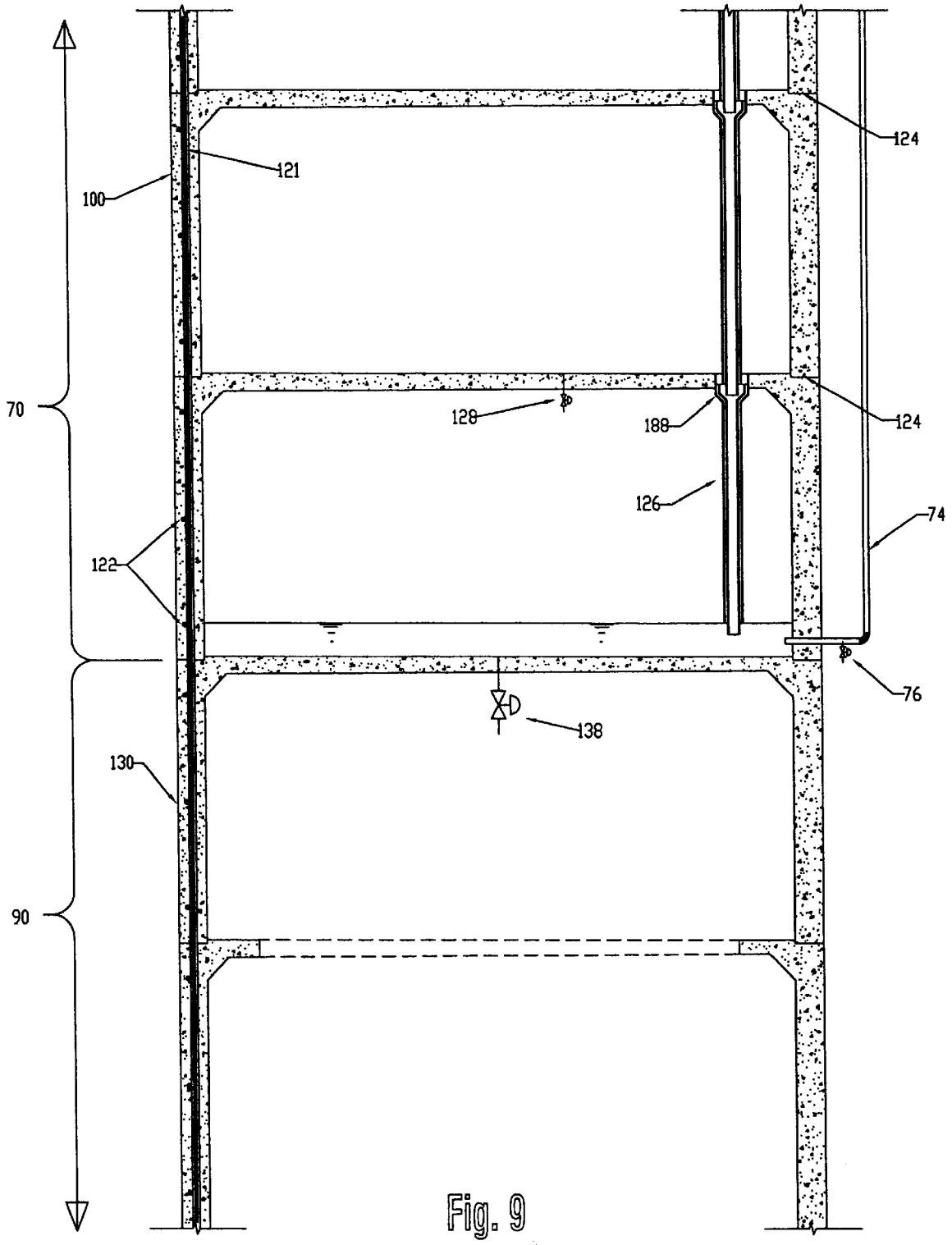
FIG. 9 is an enlarged sectional view of equalized pressure system and trim system of the present invention.

The spar uses an equalized pressure system that pressurizes the interior compartments of the segments to approximate the pressure of the sea water on the outside of the structure and to maintain the desired draft. As best illustrated in FIGS. 9–12, the equalized pressure system includes a plurality of double walled equalized pressure pipes (126) extending through the segments (100) forming the buoyancy section (70), a segmented vertical column of water (182) residing in the pipes (126), buoyancy cells (114, 116), control tanks (184), remote controlled trim valves (128), and a water pump (187). The equalized pressure system allows the pressure within any cell (114, 116) at any depth to be approximately equal to the external water pressure at the same depth. The inner equalized pressure pipe (186) of the double walled pipe (126) is adapted to carry water (183). As shown in FIG. 9, a pipe hub (188) embedded within the top slab (102) allows the inner pipe (186) descending from the above segment to be inserted a sufficient distance (d) below the free water surface (192) to ensure air (78) will not enter the inner pipe (186), even during large pitch and roll motions of the spar (10). By preventing air (78) from entering the inner pipe (186), the water of the water column (182) is not affected. If air were permitted to displace the water in the water column (182), the head pressure of the water column would be lowered causing an unequal or differential pressure between the water pressure outside and the air pressure inside the segment. Water resistant adhesive type material (80) coating the keyway (124) of a segment provides a secure and substantially airtight sealer between the cells of stacked buoyancy segments (100).

Figure 11:
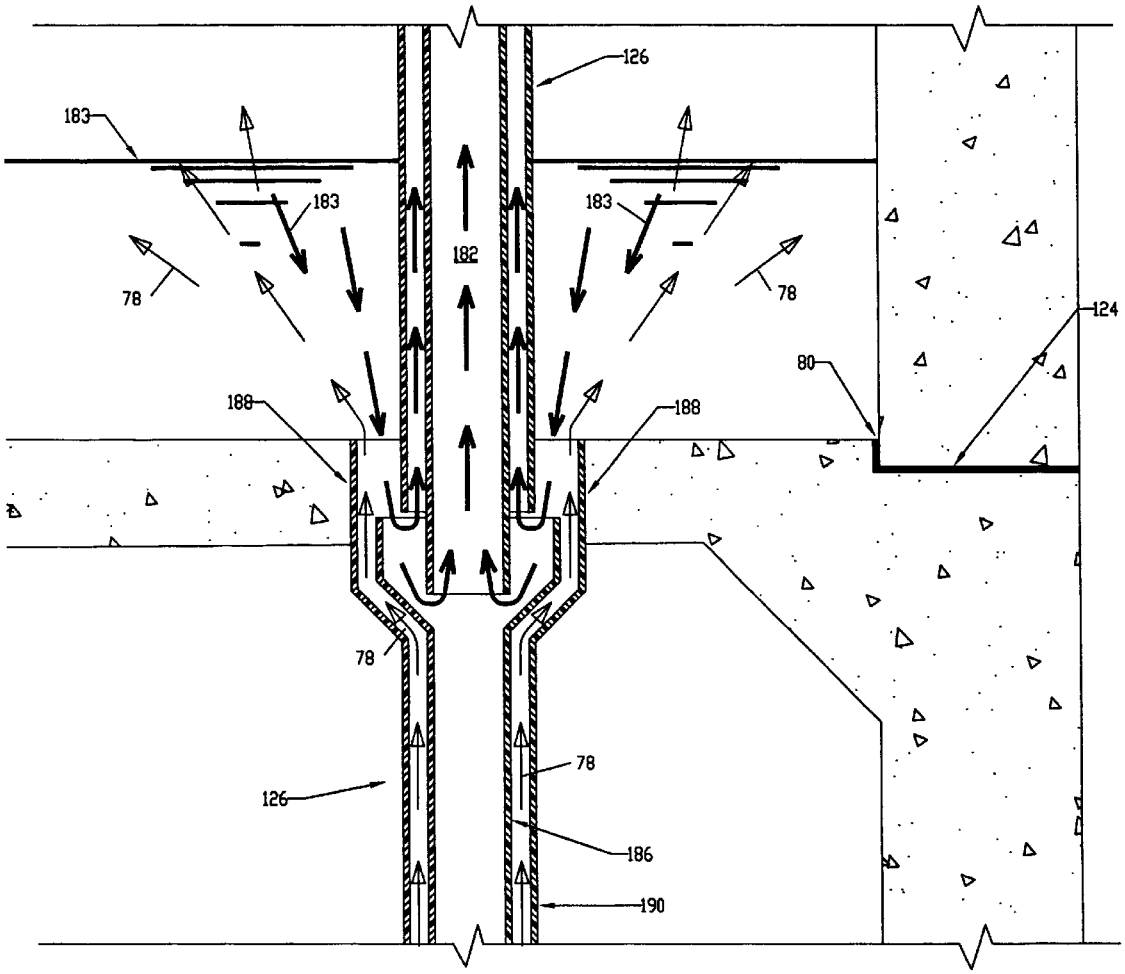
FIG. 11 is an enlarged sectional view of air and water flow during setup operation indicated by reference in FIG. 9.

As shown in FIG. 11, the inner pipe (186) is also used to evacuate water (183) being displaced from the segments (100) of the buoyancy section (70) during the upending of the spar from the horizontal towed position to the vertical operational position. High pressure air (78) is pumped into the buoyancy segments (100) filling the cells with air (78) and displacing the water (183). This displaced water (183) is forced into and up through the double walled pipe (126) and ultimately into the control tanks (184) (illustrated as top segments of the pipe (126) in FIG. 12), causing the water level within the control tanks (184) to rise. The excess water in the tank (184) is then discharged into the moon pool (26) by water pumps (187) located within the control tanks (184).

Figure 10:
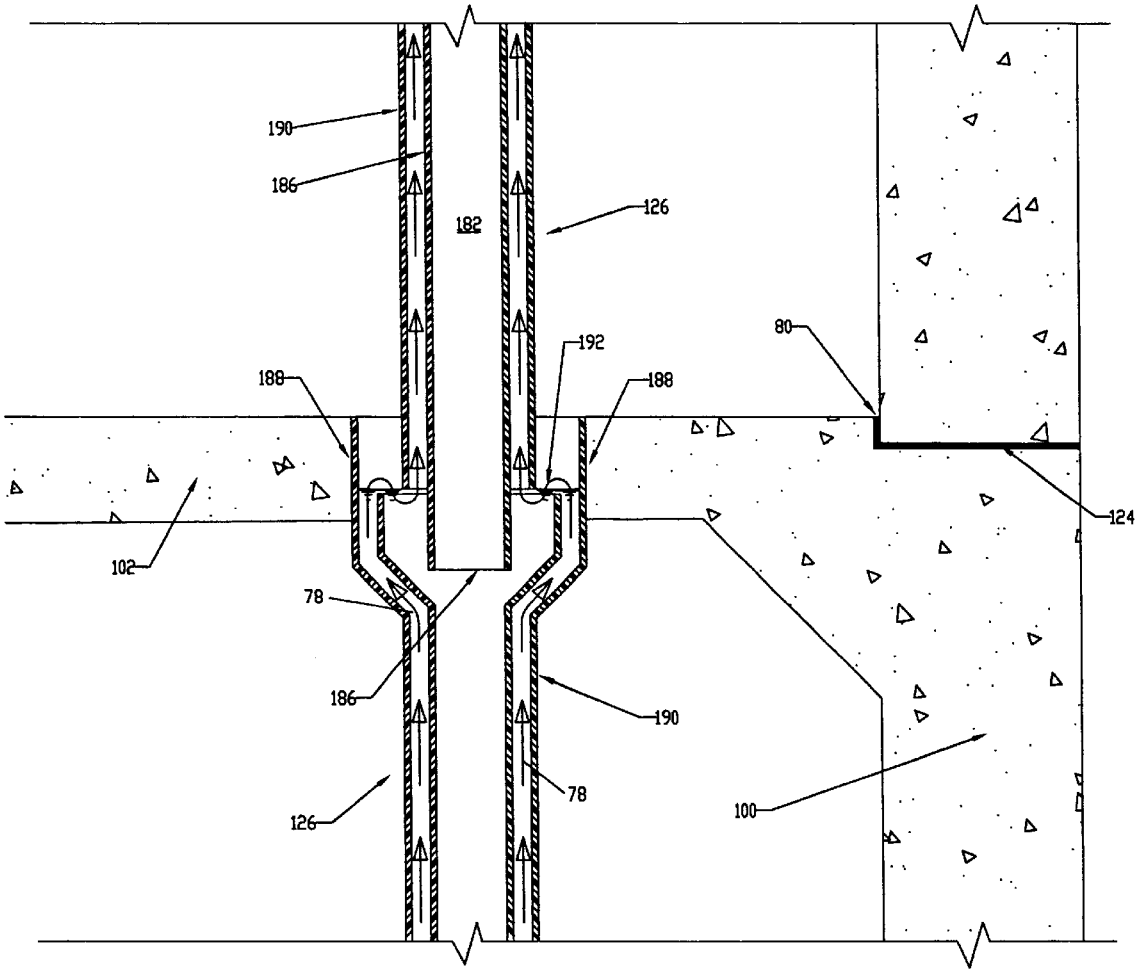
FIG. 10 is an enlarged sectional view of air flow during operational condition indicated by reference in FIG. 9.

Turning to FIGS. 10 and 11, the outer equalized pressure pipe (190) of the double walled pipe performs in a similar manner as the inner pipe (186). The outer pipe (190) creates an annulus between the inner and outer pipes. During the upending process the annulus carries both air and water. When pressurized air (78) is pumped into the cells and begins to displace water (183), the displaced water (183) is discharged upward through the ascending inner pipe (186) and outer pipe (190) while the annulus below is carrying the rising pressurized air (78). When the displaced water level (192) reaches the bottom of the outer equalized pressure pipe, the pressurized air (78) will then rise into the annulus and be discharged into the cell (114) of the next above segment (100). This process continues until the water has been displaced from within the buoyancy section (70) of the structure with the valves (128, 138) closed, there is no flow of water into or out of the buoyancy section (70) permitted and therefore there is no dynamic water movement inside the cells caused by external water forces acting on the spar structure.

Figure 12:
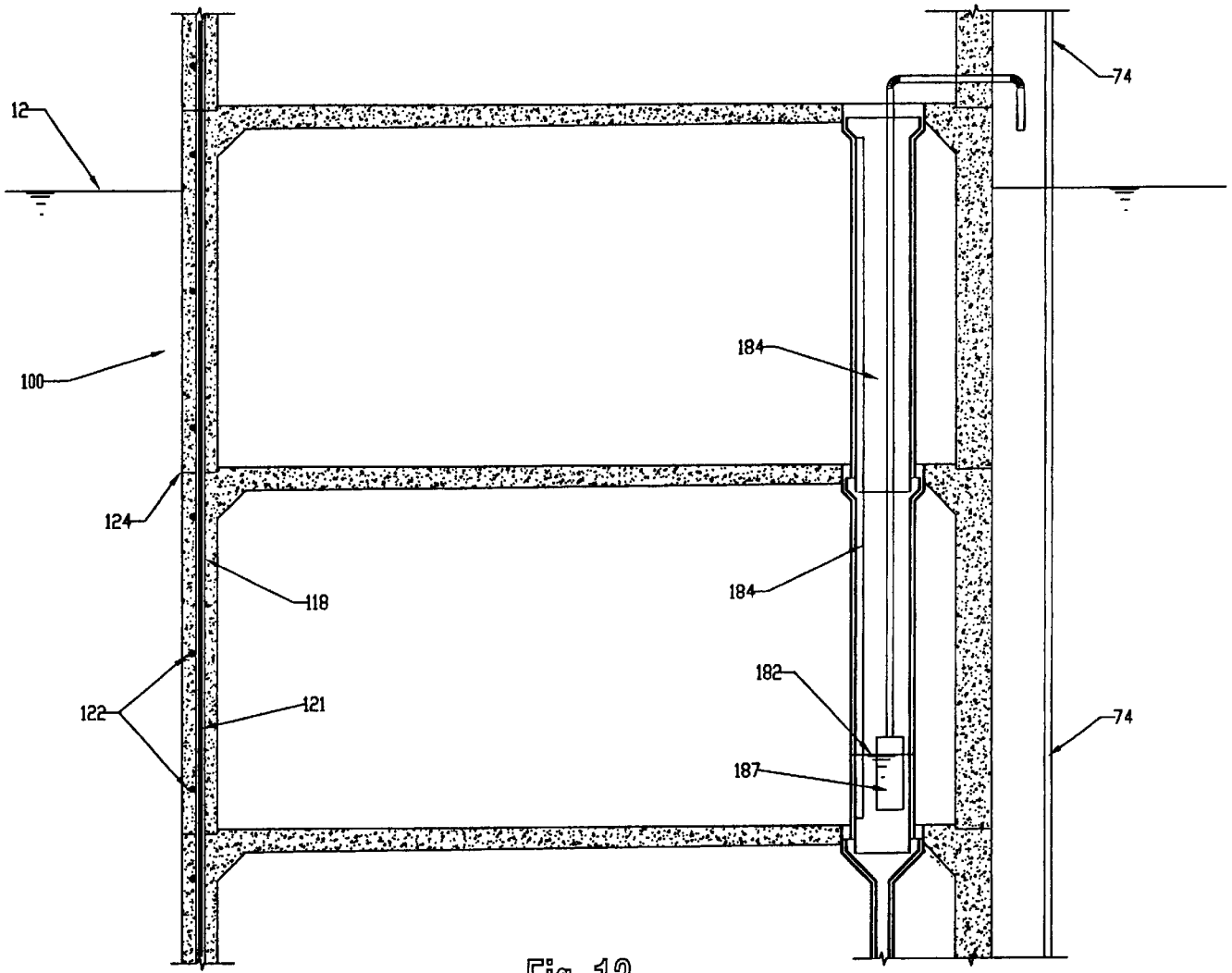
FIG. 12 is an enlarged sectional view of the equalized pressure system control tank.

Control tanks (184) located at the top portion of the buoyancy section (70) are tied directly into by the double wall equalized pressure pipes (126) and are used to monitor and adjust the height of the water column (182) within the system. These control tanks contain sensors and switches (not shown) designed to sense and adjust the height of the water column (182). As shown in FIG. 12, the water level (182) within the control tank (184) can be set so that the height of the water column (182) is less than water surface (12) outside the structure (10). This will create a slight negative differential pressure between the inside of the buoyancy section (70) and the external water pressure at any depth along the length of the buoyancy section (70). This will minimize air leaks out of the buoyancy section (70) through the outer walls of the spar, including cold joints located at the juncture of two segments. Water leaking into the buoyancy section (70) through an outer radial wall (110) can cause the water level within the control tank (184) to rise. If the water level reaches high level sensors, water pumps (187) will be switched on lowering the water level to the operational position. If the water level within the control tank (184) begins to drop, this may be read as an indication that air is leaking out of a buoyancy segment (100) allowing water from the column (182) to flow into the segment (100) where the leak is occurring. Once the water level (182) within the control tank (184) drops and reaches low level sensors, an air compressor may be switched on pressurizing the buoyancy section (70) driving out excess water.

Method of Construction

The precast modular spar is constructed using assembly line manufacturing techniques at a construction plant (200) which provides a high level of uniformity. Turning to FIGS. 13 and 14, the construction process starts with the pre-tying of reinforcing cages (202) on special made templates designed to match the mold dimensions, yet facilitate easy entry for workers to tie the reinforcing steel. The cages include post-tension conduits and embedded items. The cages (202) are preferably pre-tied a minimum of one day prior to being transported to and installed in concrete molds (204). This pre-trying facilitates the casting of one segment per mold, per day. The pre-tied cages (202) are set into automated concrete molds (204) by a heavy-lift gantry crane (206). The molds are then closed to a liquid tight fit to facilitate the placement of liquid. Concrete is then poured into the mold (204). The concrete is cured within the mold (204) until it has reached approximately fifty percent of its design strength or approximately twelve hours, at which times the mold (204) is opened enabling the heavy-lift gantry crane (206) to lift the segment (208), be it in the form of a buoyancy segment (100) or a ballast segment (130), out of the mold.

The segments (208) are moved to a surge yard (210) where they are set onto level footings for final curing. At the surge yard the double walled equalized pressure pipes (126), pipe hubs (188), valves (128, 138), sensors, and any other mechanical outfitting is installed. Once the segments (208) have reached one-hundred percent of their design strength and all mechanical outfitting is completed, they are picked up and transported by the heavy-lift gantry crane (206) to an erection area for assembly into modules (150).

The pie shaped segments (100 or 130) are assembled to form circular shaped modules (150) The segments (100 or 130) are secured to like adjacent segments of a module (150) by water resistant, adhesive material that is placed on the contact surfaces of the adjacent segments. Block outs in the outer radial walls (110, 140) or pilasters out of the outer radial walls (110, 140) allow circumferential post-tensioning of the module to keep the segments (100 or 130) in place (not shown). Circumferential post-tensioning of the module (150) is accomplished through the use of a plurality of cables routed through conduits (122) and will start at one point and extend 180 degrees around the module (150) in a circumferential overlapping fashion.

A unit (160) is then assembled in an assembly area which can either be on land or on submersible barges. After a module (150) is post-tensioned, segments it is stacked together with one or more similar modules to form another single row module (150) on top of the first single row module (150) to form a unit (160). In a unit (160), the segments (100 or 130) are stacked so that the middle tangential walls (104 or 141) are aligned with an outer tangential wall (106 or 139) of upper and lower segments to interlock all modules (150) throughout the height of a unit (160). The segments (100 or 130) are aligned on top of other segments by the use of a keyway (124) on the top of the walls of the lower segment. This keyway (124) assures a relatively accurate vertical alignment of the segments (100 or 130). During assembly, all mating surfaces of adjacent segments and stacked segments (100 or 130) are coated with water resistant adhesive material (80) to join the segments (100 or 130). Circumferential post-tensioning of each module is conducted in the same manner as for the first row module. The process of stacking modules (150) is repeated until the formed unit (160) reaches a pre-selected height relative to the diameter of the spar (10). The unit (160) is then post-tensioned vertically with strands (121) through pre-installed, post-tension vertical conduits (120) located within the walls of the segment (100 or 130). Only enough conduits (120) to keep the unit (160) together when the unit is rolled from the vertical position to a horizontal position are post-tensioned at this time. The remaining conduits (118) will be used in post-tensioning after assembling the horizontal units as described later. The unit is post-tensioned with a continuous multiple strand post-tension system. In the preferred process, the spar is assembled in the horizontal position. However, the assembly can be accomplished in the vertical position for constructing floating structures without a deep draft.

Figure 14A:
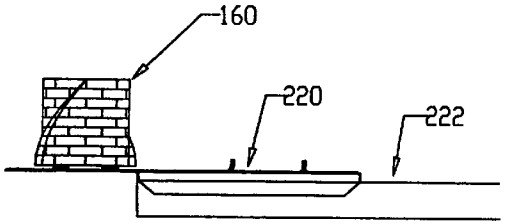
FIG. 14 are elevational views showing successive steps during one implementation of the method in accordance with the invention.
Figure 14B:
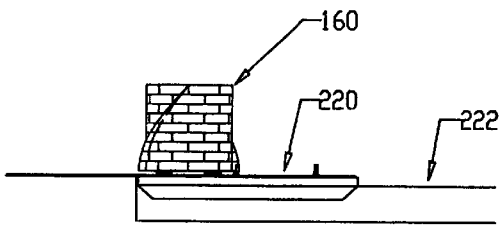
Figure 14C:
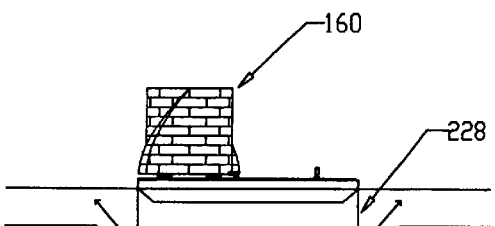
Figure 14D:
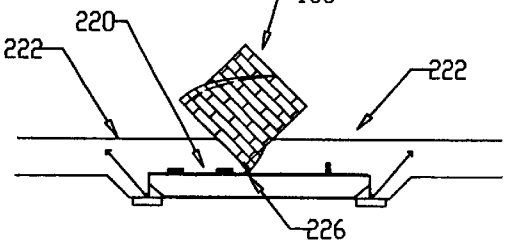
Figure 14E:
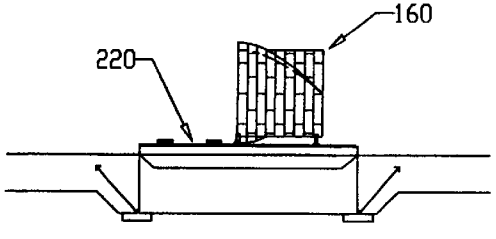
Figure 14F:
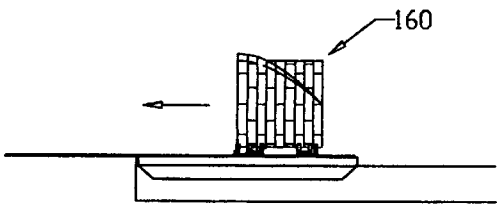
Figure 14G:
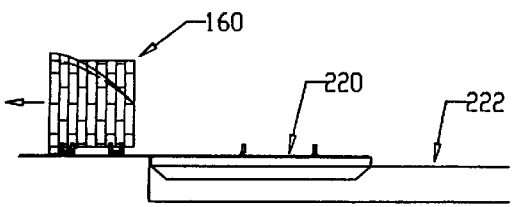

The final assembly of a spar (10) can be either on shore or in the water by linking a selected number of units (160) together and then post-tensioning them using a multiple strand post-tensioning system. Turning to FIG. 14, in the preferred process, the units (160) will be moved from their vertical position to a horizontal position by using water (222) to upend the units (160). If the unit was assembled on land, the unit is moved to a submersible barge (220) which is then towed to a deeper water dredged site (224). A pivot joint (226) holds the unit (160) securely to the barge (220). Guidelines (228) are attached to the submersible barge (220) at the dredged site (224) to guide the barge as it is submerged. Ballast water is used to cause the barge (220) to begin to submerge. As the barge descends, the unit (160) will begin to float, as shown in FIG. 14D. Since the unit (160) is connected to the barge (220) at a pivot joint (226), it will begin to lay over as the barge descends. Since the metacentric height of the unit (160) is slightly below the center of gravity, the unit will begin laying over when the unit reaches its normal buoyancy, at that time the submersible barge will begin discharging ballast water to start ascending. As the barge ascends, the unit (160) will continue to lay over until it reaches its full horizontal position as shown in FIG. 14E. The barge is then towed to the spar erection site (230) and the unit is moved off the submersible barge.

The unit (160) is then assembled with other units (160) to form the spar (10). The number of units used will be selected depending on topside loading and the water conditions in which spar is to be used. In the drawings, a spar is shown with eight units of approximately 100 feet in length to form the spar. Once all eight units have been joined they are post-tensioned using a continuous multi-strand post-tensioning system. The completed spar is then towed in its horizontal position to the production site with sea going tug boats.

While there are several different types of materials which could be used in constructing the spar, in the preferred embodiment the following materials are preferred. The material used for casting is high strength concrete with a minimum density of 130 lbs per cubic ft and a compressive strength of 7,000 psi to 10,000 psi. The reinforcing steel is grade 40 steel or better. The multi-strand post-tensioning system uses 0.5" or 0.6" diameter 7 wire, uncoated, stress-relieved or low relaxation grade T70 strands. The post-tensioning strands are housed within plastic post-tension conduits and grouted after tensioning to bond the strands to the structure for added corrosive protection of the strands.

Figure 15:
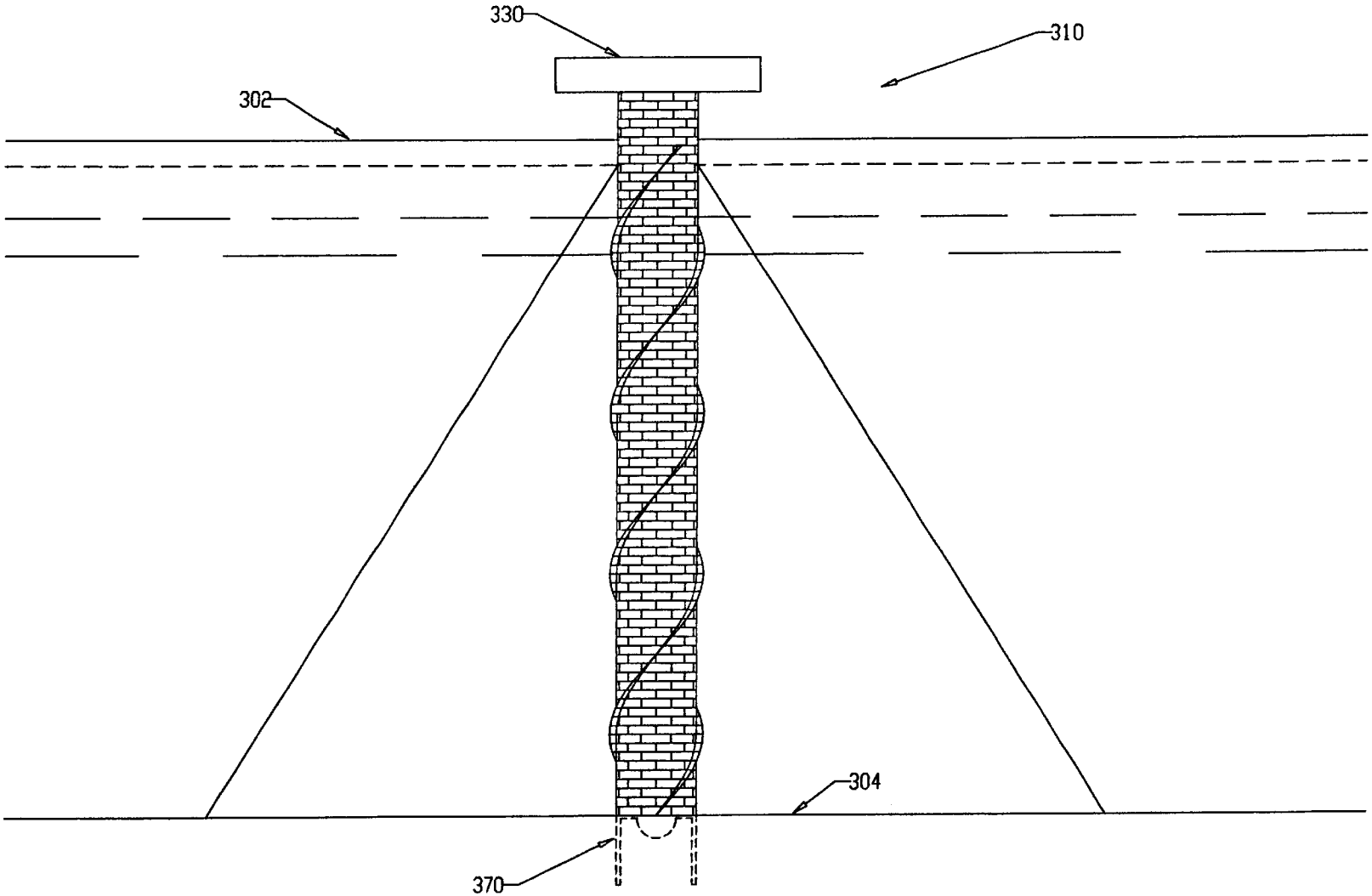
FIG. 15 is an elevation view of an alternate embodiment of this invention.

An alternate embodiment of the present invention is shown in FIG. 15. In this embodiment, a tension shaft system is constructed in accordance with the above described disclosure. A cylindrical spar (310) is constructed by linking and post-tensioning the horizontal units. This cylindrical buoy (310) is adapted to the topside loading (330) and the water conditions at the production site. For example, if the water (302) is one thousand feet deep the tension shaft system would consist of 10 units of 100 feet length. Upon assembly of the tension shaft (310) in its horizontal position it would be towed to its site similar to the spar listed above and then upended to its vertical position as disclosed above. Before transferring the buoyancy from the moon pool to the buoyance section, the skirt foundation (370) would need to be set by adding more ballast water to the moon pool allowing the skirt foundation (370) to penetrate the seabed (304). As the skirt foundation (370) penetrates the seabed (304), high pressure water is pumped into a piping system to remove the silt layer. Once the skirt is in its final position and silt has been removed from inside the skirt foundation (370), concrete is pumped into the skirt foundation through concrete injection pipes, creating a combination gravity and suction foundation. Upon completing a foundation system, the buoyancy can be transferred from the moon pool to the buoyance section. Additional buoyancy can be provided by reducing the water level in the moon pool.

We claim:

1. A precast, modular spar system comprising:

a. a cylindrical open-ended spar of relatively uniform cross section throughout its length and having a length such that its upper end extends above the water surface and its bottom end is subject to only minimal excitation forces caused by waves, said spar comprising a freeboard section, a buoyancy section, and a ballast section;

b. a plurality of arcuate shaped segments having a middle tangential wall, at least two outer tangential walls, an outer radial wall, an inner radial wall, and a top slab; said segments adapted to be in a stacked relationship with an adjoining segment;

c. said segments comprising said ballast section having a passageway extending through said top slab;

d. an equalized pressure system for pressuring the spar throughout its length and to approximate the pressure of the sea water on the outside of the spar system, said equalized pressure system comprising a plurality of double walled equalized pressure pipes extending through said segments of said buoyancy section, a plurality of segmented water columns within said double walled pipes, means for injecting air into said segments;

e. a moon pool open at the bottom and containing water non-excited by waves centrally extending the entire length of the spar and defined by inner radial walls of said sections.

2. The spar system of claim 1, further comprising a compression dome removeably attached to the bottom of said ballast section.

3. The spar system of claim 2, wherein said compression dome further comprises a plurality of ports into said moon pool.

4. The spar system of claim 1, further comprising at least one fill valve in said ballast section and at least one fill valve in said buoyancy section.

5. The spar system of claim 4, wherein said fill valves open to allow water to enter said ballast section and said buoyancy section to rotate said spar to a second vertical position offshore.

6. The spar system of claim 1, wherein said buoyancy section attaches to said freeboard section in a first horizontal assembly position and said ballast section attaches to said buoyancy section in said first horizontal assembly position.

7. The spar system of claim 6, wherein said first horizontal assembly position is onshore.

8. The spar system of claim 1, further comprising a platform deck secured to said freeboard section.

9. The spar system of claim 8, wherein said platform deck is a production deck supporting oil/gas production equipment.

10. The spar system of claim 9, further comprising means for transporting oil/gas between the sea floor and said production deck through said moon pool.

11. The spar system of claim 10, wherein said means for transporting oil/gas further comprises a riser system having riser pipes extending from said sea floor to said production deck through said moon pool.

12. The spar system of claim 1, further comprising means for anchoring said spar to the sea floor.

13. The spar system of claim 12, wherein said anchoring means further comprises a plurality of mooring lines attached to a plurality of mooring line storage reels at said freeboard section of said spar.

14. The spar system of claim 13, wherein said anchoring means further comprises transverse anchor lines.

15. The spar system of claim 1, wherein said buoyancy section having a weight adding dense material therein.

16. The spar system of claim 1, wherein said means for injecting air into said segments comprises at least one air inlet attached to said plurality of double walled pipes, a plurality of control tanks connected to said double walled pipes, and at least one air compressor attached to said control tanks.

* * * * *